United States Patent [19]

Van Hest

[11] Patent Number: 5,038,939

[45] Date of Patent: Aug. 13, 1991

[54] PACKED ELECTRIC LAMP

[75] Inventor: Wilhelmus J. J. Van Hest, Eindhoven, Netherlands

[73] Assignee: U.S. Philips Corporation, New York, N.Y.

[21] Appl. No.: 558,016

[22] Filed: Jul. 25, 1990

[30] Foreign Application Priority Data

Aug. 17, 1989 [NL] Netherlands ..... 8902078

[51] Int. Cl.[5] ..... B65D 81/02

[52] U.S. Cl. ..... 206/583; 206/418

[58] Field of Search ..... 206/418, 583, 588, 592, 206/521

[56] References Cited

U.S. PATENT DOCUMENTS

| | | | |
|---|---|---|---|
| 1,701,059 | 2/1929 | Andrews | 206/418 |
| 1,704,739 | 3/1929 | Larigg | 206/583 X |
| 1,896,326 | 2/1933 | Northway-Ley | 206/418 |
| 3,182,885 | 5/1965 | Maio | 206/418 X |
| 3,547,256 | 12/1970 | Bolding | 206/418 |
| 3,968,924 | 7/1976 | Tyrseck | 206/418 |
| 4,087,003 | 5/1978 | Adanchi | 206/583 |

FOREIGN PATENT DOCUMENTS

| | | | |
|---|---|---|---|
| 0241097 | 10/1925 | United Kingdom | 206/418 |
| 258925 | 9/1926 | United Kingdom . | |
| 0290841 | 5/1928 | United Kingdom | 206/418 |
| 0952295 | 3/1964 | United Kingdom | 206/418 |

*Primary Examiner*—Bryon P. Gehman

*Attorney, Agent, or Firm*—Brian J. Wieghaus

[57] ABSTRACT

An electric lamp is packed in a rectangular sleeve, in which a holder extends from a first edge of the sleeve up to an opposing third edge of the sleeve. The holder has interconnected partitions provided with windows between which the lamp is enclosed. The partitions have tags which extend from the third edge of the sleeve to a respective nearby edge.

4 Claims, 2 Drawing Sheets

PACKED ELECTRIC LAMP

BACKGROUND OF THE INVENTION

The invention relates to a carton for electric lamps and to an electric lamp packed in a carton. More particularly, the invention relates to packaging of the type having a rectangular sleeve with an insertable holder which extends between diagonal edges of the sleeve.

GB 952 295 shows a carton consisting of a rectangular sleeve having longitudinal edges or folds, and a holder insertable in the sleeve, which holder extends from a first edge up to an opposing third edge of the sleeve. The holder has a first and a second partition, which partitions are provided with windows and are interconnected along the first sleeve edge. The carton is suitable to hold an electric lamp between the first and the second partition of the holder.

The windows in the partitions for the known lamp are larger than the packed lamp. The edges of the windows have tags which follow the shape of the lamp, so that the partitions hold the lamp.

Drop tests have shown that the known packing or carton offers insufficient protection for the lamp since the holder loses its grip on the lamp. Lamp fractures frequently occur.

GB 258 925 also discloses a carton for an electric lamp in which a holder extends in a rectangular sleeve from a first to a third edge of the sleeve. The holder has two rectangular partitions, each provided with a window, which partitions are interconnected along a folding line extending transversely to the edges of the sleeve. The holder has short tags which bear on a wall of the sleeve.

The holder has a double lid, a portion of which is recessed in the sleeve and has an opening for accommodating the lamp cap of the lamp. Without this double lid the holder, which retains the lamp asymmetrically owing to the folding line between the two partitions, would lose its grip on the lamp in the case of a drop or an impact.

In addition, the holder is badly fixed in the sleeve. The width of the holder is greatest at the area of the folding line and at most equal to the diagonal of the sleeve bottom. When enclosing an electric lamp, the partitions are made convex, so that the holder becomes narrower and no longer extends fully from a first to a third edge, while it also develops a lateral opening. The packing is not suitable for packing tubular lamps having an electric cable at either end.

SUMMARY OF THE INVENTION

The invention has for its object to provide a carton for an electric lamp and on electric lamp packed in a carton of the type described in the opening paragraph which is effectively protected against repeated shocks and nevertheless is of a simple construction, requires little packing material, and is easy to assemble.

This object is achieved in that the partitions of the holder have tags which extend from the third edge of the sleeve to a respective nearby edge.

It has been shown that the tags of the partitions of the holder prevent these partitions from sliding apart along the relevant walls of the sleeve away from the third edqe in the case of a shock, for example a drop. The result is that the holder keeps its grip on the lamp.

In a favourable embodiment the windows in the partitions have a shape and size which correspond essentially to a longitudinal section of the lamp parallel to and at a certain distance from a plane through the first and third edges, so that a proper fixation of the lamp is obtained.

If the cross-sectional dimensions of a lamp show considerable differences in the longitudinal direction along the lamp, for example owing to a local narrowing of the lamp vessel merging into a wider lamp cap, the window in a partition may be multiple.

In a favourable embodiment, the partitions and the associated tags are made from one integral piece of packing material, such as, for example, duplex cardboard, and interconnected by folding lines.

The lamp can be assembled with the packing or carton in a very simple way. The lamp can be laid on a partition of the holder, after which the other partition is doubled over against the lamp. Any lamp cables present can be wound around the partitions. The holder, with its tags bent towards the partitions, can easily be slid into the sleeve, after which the tags spring outwards and assume their final positions.

The holder is highly suitable for use instead of the holders made of sheets of synthetic foam material which are usual now and which are wound around the lamp and entirely fill up the sleeve. The synthetic sheets are relatively expensive and pollute the environment. Enveloping a lamp, moreover, is much more time consuming than assembling a lamp together with a holder according to the invention, especially when a lamp with connecting cables is to be packed.

BRIEF DESCRIPTION OF THE DRAWING

An embodiment of the packed electric lamp according to the invention is shown in the drawing in which.

DESCRIPTION OF THE PREFERRED EMBODIMENT

Figure 1:
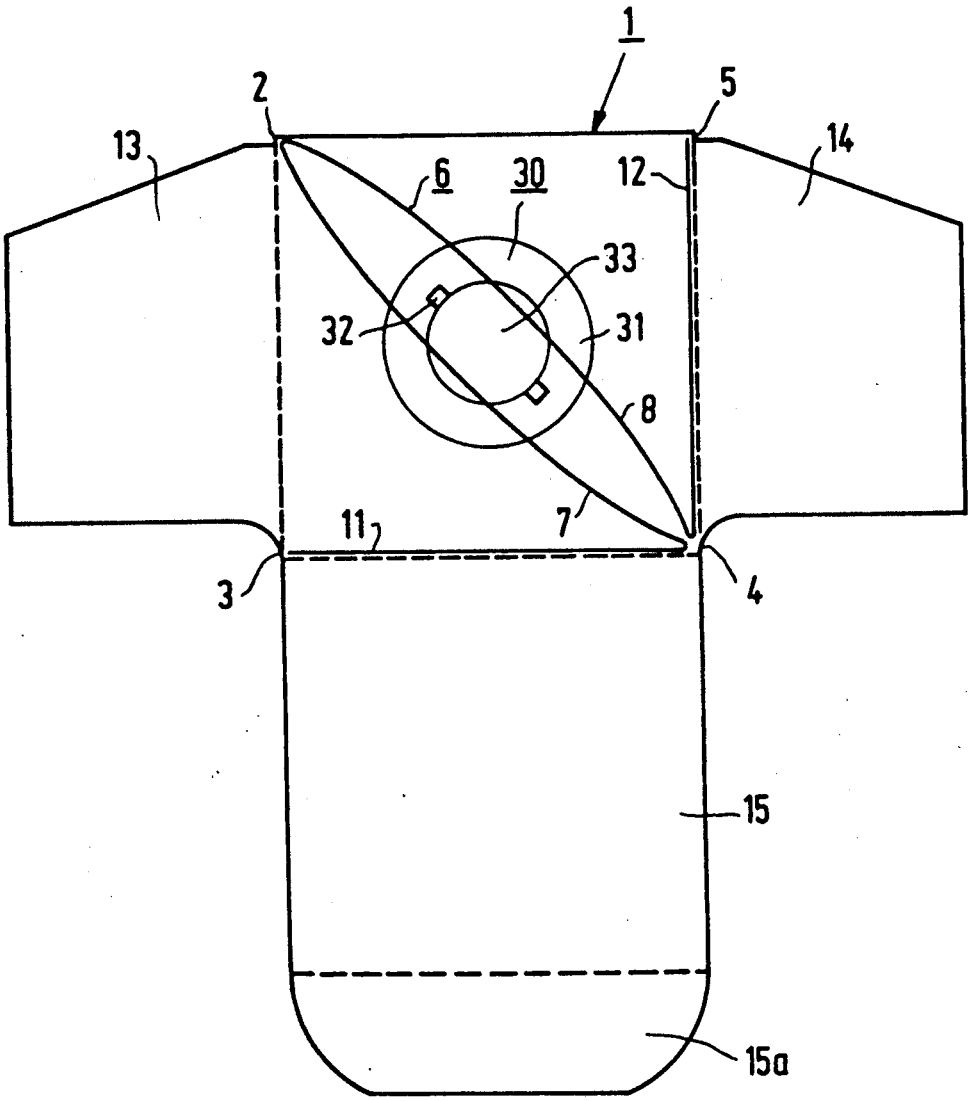
FIG. 1 is an end view of the carton with an open sleeve, and a lamp packed therein.

The carton of FIG. 1 has a rectangular sleeve 1 with edges 2–5. The sleeve has a closure with side flaps 13–14 and an end flap 15, 15*a*.

Inside the sleeve there is a holder 6, which extends from a first edge 2 up to a diametrically opposed third edge 4 of the sleeve 1. The holder has a first 7 and a second partition 8, which are provided with windows 9, 10 (FIG. 2) and which are interconnected along the first edge.

An electric lamp 30 is enclosed between the first 7 and the second partition 8.

The said partitions 7, 8 have tags 11, 12, respectively, which extend from the third edge 4 of the sleeve 1 to a nearby edge 3, 5, respectively.

Figure 2:
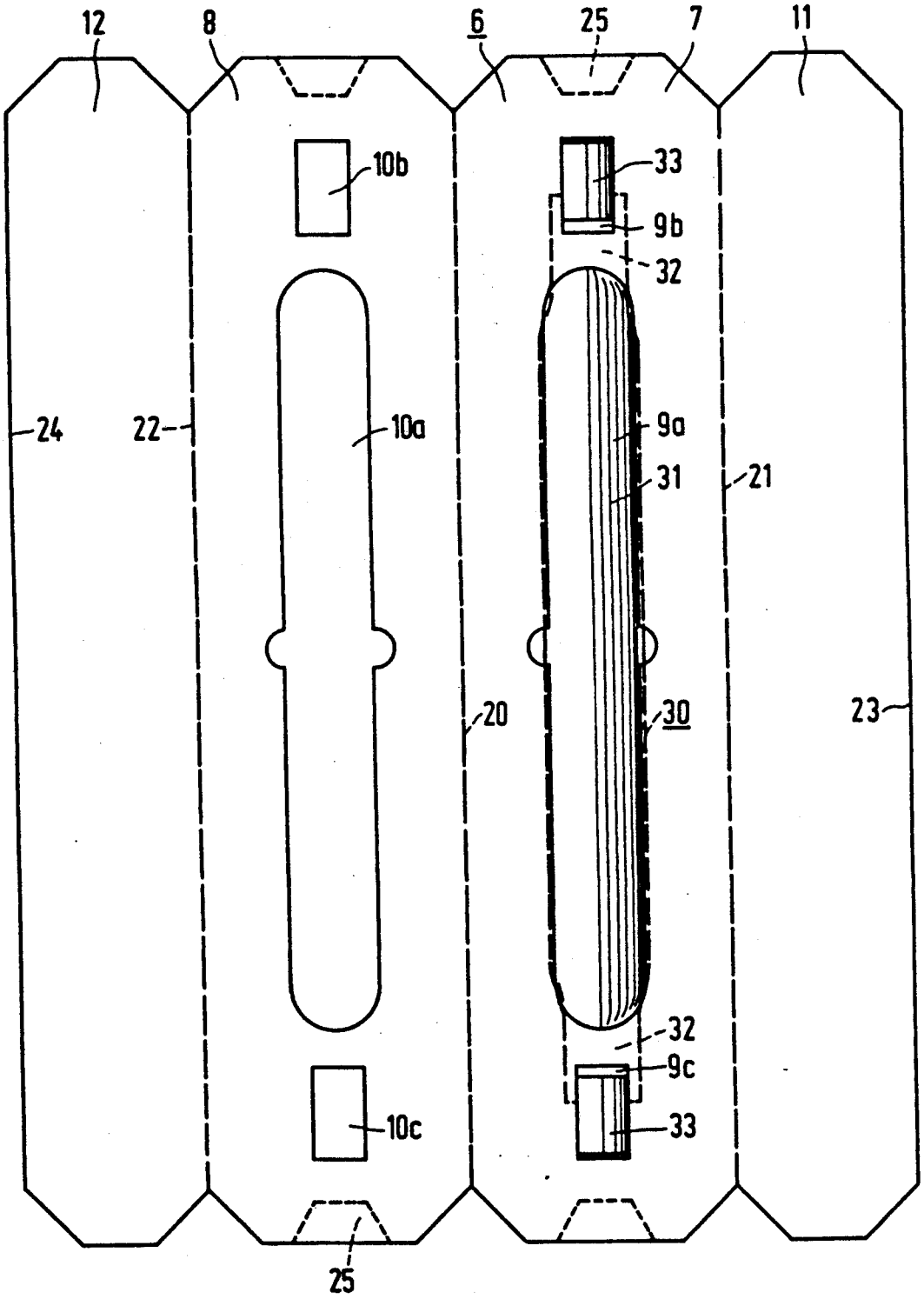
FIG. 2 shows the holder of FIG. 1 folded out flat, with the lamp.

In FIG. 2, the partitions 7 and 8 of the holder 6 are interconnected by a convex fold 20. The partition 7 is connected to the tag 11 with a concave fold 21, the partition 8 with tag 12 by a concave fold 22.

The electric lamp 30 lies under the partition 7.

The lamp has a lamp vessel 31 of relatively large diameter, lamp caps 33 of relatively small diameter and flat seals 32. The lamp shown is a sun lamp.

Windows 9, 10, shaped in accordance with a longitudinal section of lamp 30 parallel to and at a certain distance from a plane through the edges 2 and 4 (FIG. 1), are each of multiple design 9*a–c*, 10*a–c*, respectively.

Assembly can take place in a very simple manner by laying the holder of FIG. 2 upside down on a work surface and depositing the lamp 30 on the window 9*a–c* of partition 7. The partitions 7 and 8 can be revolved towards another and the tags 11 and 12 can be folded towards the respective panels in one movement. By holding the holder 6 with the lamp 30 inside between thumb and fingers on the tags 11, 12 near their edges 23, 24, respectively, an operator can easily slide the total assembly into the sleeve 1.

The sleeve and the holder form a very solid packing, which is easily assembled and handled, and in which the lamp can be quickly inserted. If the lamp is provided with cables issuing from respective lamp caps, the partitions 7, 8 may contain recesses 25 through which the cables can be guided if these cables are wound around the holder 6 with the lamp 30 inside just before these are inserted in the sleeve 1.

The tags 11, 12 are highly suitable for the application of information about the electric lamp, such as, for example, operating or safety instructions.

The packing offers the lamp a reliable protection.

I claim:

1. In a carton having a tubular rectangular sleeve having four longitudinal edges, and an insertable holder inserted into said sleeve and having first and second partitions diagonally disposed between a first sleeve edge and a diagonally opposing third sleeve edge, said partitions being connected to each other along said first sleeve edge and having windows for holding an article between said partitions, the improvement comprising:

said holder having a tag extending from each partition along said third sleeve edge to a respective sleeve edge between said first and third sleeve edges for holding said partitions together along said third sleeve edge.

2. A carton according to claim 1, wherein said partition windows have a shape substantially corresponding to a cross-section of the article held between said windows taken in a plane parallel to and at a certain distance from the a plane through said first and said third sleeve edges.

3. A packed electric lamp, comprising:

an electric lamp; and a carton holding said electric lamp, said carton comprising a tubular rectangular sleeve having four longitudinal edges, and an insertable holder inserted within said sleeve and having first and second partitions diagonally disposed in said rectangular sleeve between a first sleeve edge and diagonally opposing third sleeve edge, said partitions being interconnected to each other along said first sleeve edge and having windows between which said electric lamp is held, each partition further having a tag which extends therefrom along said third sleeve edge to a respective sleeve edge between said first and third sleeve edges for holding said partitions together along said third sleeve edge.

4. A packed electric lamp as claimed in claim 3, characterized in that said windows have a shape substantially corresponding to a cross-section through the lamp in a plane parallel to and at a certain distance from a plane through said first sleeve edge and third sleeve edge.

* * * * *